United States Patent [19]

May

[11] Patent Number: 4,815,788

[45] Date of Patent: Mar. 28, 1989

[54] THREE-WAY INCLINER

[75] Inventor: Teddy J. May, Tupelo, Miss.

[73] Assignee: Super Sagless Corp., Tupelo, Miss.

[21] Appl. No.: 67,107

[22] Filed: Jun. 25, 1987

[51] Int. Cl.[4] ..... A47C 1/035

[52] U.S. Cl. ..... 297/68; 297/75; 297/85; 297/318; 297/322

[58] Field of Search ..... 297/68, 75, 83–85, 297/88, 317, 318, 322, 341, 342, 344; 248/429, 430

[56] References Cited

U.S. PATENT DOCUMENTS

| | | | |
|---|---|---|---|
| 2,492,106 | 12/1949 | Orton | 297/318 |
| 3,269,769 | 8/1966 | Mizelle | 297/322 X |
| 3,363,942 | 1/1968 | Fletcher | 297/322 |
| 3,958,827 | 5/1976 | Ré | 297/322 X |
| 4,071,275 | 1/1978 | Rogers, Jr. | 297/322 X |
| 4,531,778 | 7/1985 | Rogers, Jr. | 297/318 X |
| 4,648,141 | 3/1987 | Mansouris et al. | 248/430 X |

FOREIGN PATENT DOCUMENTS

| | | | |
|---|---|---|---|
| 661131 | 4/1963 | Canada | 297/68 |

*Primary Examiner*—Kenneth J. Dorner
*Assistant Examiner*—Peter R. Brown
*Attorney, Agent, or Firm*—Wolf, Greenfield & Sacks

[57] ABSTRACT

A wall proximity three-position reclining chair having a seat and frame assembly which moves with respect to a fixed base and which has a backrest movable with respect to the seat. The seat and frame assembly and backrest are carried by a handle actuated mechanism which includes a seat mounting link supported by swing links in turn suspended from a support link. The support link is carried on front and rear pivot links mounted on a fixed base plate. A slidable pivotal connection is provided between the base plate and front pivot link while the pivotal connection for the rear pivot link is fixed. A control link interconnects the two pivot links and prevents the mechanism from collapsing and reduces the arc through which the front pivot link must swing to recline the chair.

12 Claims, 4 Drawing Sheets

Fig. 1
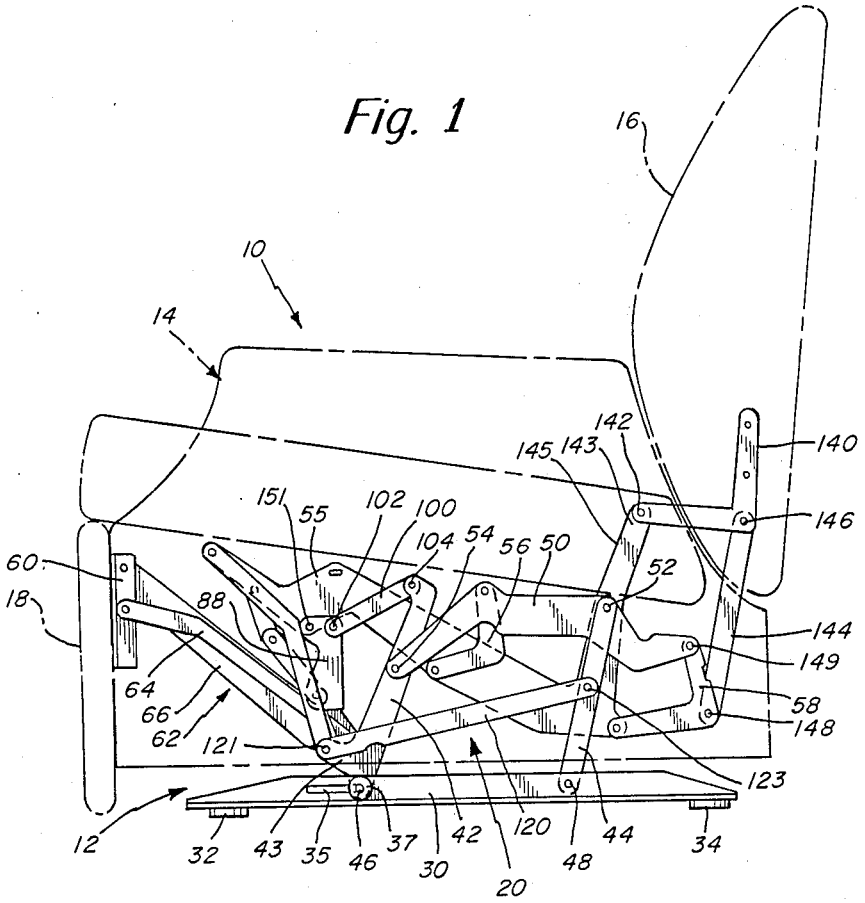
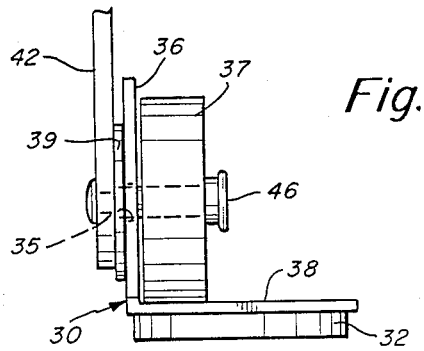
Fig. 4

THREE-WAY INCLINER

INTRODUCTION

This invention relates to reclining chairs and more particularly relates to three-position recliners which may be placed in close proximity to a wall or other furniture without interference when the chair is reclined.

Reclining chairs have enjoyed great popularity for many years. Literally millions of reclining chairs have been sold.

The early reclining chairs required that they be placed several feet from the wall or other furniture in order to enable the backrest to recline fully without interference. Many of the early reclining chairs had fixed arms, and to move the chairs to a reclining position, the occupant would push against the arms so as to force his or her body against the backrest. In that type of chair, the reclining action is achieved by tilting the seat and backrest rearwardly and downwardly with respect to the chair arms, which, of course, moves the backrest toward the wall. That action required substantial clearance between the wall and backrest when the chair is in the upright position.

In the late 1960s and the 1970s, particularly as housing units became smaller, the chair manufacturers sought ways to modify the construction to enable the chairs to be placed closer to the wall without interference from the wall as they moved from the upright position to a reclining position. Examples of some those chairs are shown in U.S. Pat., Nos. 3,874,724; 4,077,663; 4,099,776; 4,153,292; 4,195,878 and 4,202,580. Many of these wall proximity chairs employ long tracks, on which the entire chair including the base and frame move forwardly as the back tilts rearwardly toward the wall in response to pressure against the arms. In some constructions, the entire chair assembly including the base and frame move forwardly on the tracks away from the wall to compensate for the rearward tilting of the backrest. Some of those arrangements include channel-shaped tracks twelve inches or more in length. Roller links are carried by rollers which roll back and forth in the tracks, and the roller links in turn support front and rear pivot links that carry the seat mounting link. The long travel path of the chair frame on the tracks particularly during the reclining action creates a feeling of instability for the occupant, which many people find unacceptable. The tracks and rollers also add significantly to the manufacturing costs of the mechanisms.

In seeking to improve the styling of reclining chairs, manufacturers sought ways, for example, to enable T-cushions to be used. This is not possible in chairs in which the seat moves rearwardly with respect to the side arms, because the wings of the T-cushion engage the front of the arms and the cushion can not travel rearwardly with the seat frame. Consequently, designers sought ways to reverse the direction of motion of the seat with respect to the frame or alternatively to fix the arms with the seat so that they maintain the same relative positions with respect to one another both in the upright and reclining positions of the chair. Because the arms and seat move together in those chairs, means other than pressing against the chair arms had to be found to actuate the chairs. The wide use of handle operated actuating mechanisms in reclining chairs was the result.

More recent developments in the reclining chair art enable the chairs to be placed closer to the wall. Chair mechanisms including combinations of linkages and tracks reduced the wall clearance required, but the industry continues to look for suitable mechanisms which allow reclining chairs to be placed even closer to the wall.

How close to a wall a reclining chair may be placed is by no means the sole criteria of a chair's acceptability. The mechanism in the chair must, of course, provide a very comfortable relationship between the seat, arms and backrest. The chair mechanism must also require very little effort to operate. The action of the mechanism must be smooth so as not to impart a feeling of instability to the chair user as it moves between the upright and reclining positions. Furthermore, the nature of the industry requires that the manufacturing costs be competitive.

The development and manufacture of mechanisms has grown into a separate division within the furniture industry, and at the present time, many manufacturers employ large technical staffs and expend very substantial amounts of time and money in search for improved mechanisms.

The principal object of the present invention is to provide a linkage mechanism for reclining chairs, which enables a chair in which the mechanism is incorporated to be placed with its backrest approximately four or five inches from the wall without incurring any interference from the wall as the chair moves from upright and to reclining positions.

Another object of the present invention is to provide a relatively inexpensive mechanism having both linkages and a track, which permits the chair to be placed close to the wall.

Another object of this invention is to provide a mechanism for reclining chairs which combines the advantages of a pure linkage mechanism and a track system to achieve a smooth and stable action for reclining chairs.

Another object of the present invention is to provide a very inexpensive track system for reclining chair mechanisms.

Yet another important object of this invention is to provide an inexpensive handle operated mechanism for reclining chairs that may be placed in close proximity to the wall.

To accomplish these and other objects, the mechanism of the present invention incorporates three different motions into the chair. That is, the motion of the seat and side panel assembly is derived from three separate sources. First, a seat mounting link which carries the chair frame is swingably supported on a support link by swing links. The swing links enable the seat mounting link to move fore and aft with respect to the support link. Second, the support link is mounted on front and rear pivot links secured to a base plate, and the pivot links enable the support link to swing fore and aft with respect to the base plate. Third, a sliding pivotal connection is provided between the front pivot link and the base plate which allows the mechanism above the base plate to move forwardly on the base plate.

When the chair is moved from an upright position to an intermediate or TV position, the support link moves forwardly on its front and rear pivot links with respect to the base plate and simultaneously the pivotal connection of the front pivot link moves forwardly in a track on the base plate. When the chair moves from the TV position to the fully reclined position, the seat mounting link swings forwardly with respect to the support link so as to move the frame further away from the wall.

A handle actuating mechanism is provided to enable the chair occupant to conveniently extend the footrest and at the same time place the occupant's weight in a position to automatically drive the mechanism to the TV position. Pressure against the backrest when the chair is in the TV position in turn causes the seat mounting link to advance with respect to the support link to achieve the fully reclined position.

A control link connected between the front and rear pivot links prevents the mechanism from collapsing and reduces the swing required of the pivot links which support the seat.

The sliding pivot which provides one of the three types of motion is composed of a slot formed in the vertical flange of the base plate of the mechanism, and a roller supported pivot rivet. The roller rides on the horizontal flange of the base plate, and the pivot rivet carries the front pivot link which in turn supports the seat. The control link causes the roller to move back and forth on the base plate along the track defined by the slot and reduces the arc through which the front pivot link must swing to recline the chair.

These and other objects and features of the present invention will be better understood and appreciated from the following detailed description of one embodiment thereof, selected for purposes of illustration and shown in the accompanying drawings.

BRIEF FIGURE DESCRIPTION

FIG. 1 is a side elevation view of a reclining chair disposed in the upright position and employing the linkage mechanism of this invention;

FIG. 4 is a fragmentary front elevation view showing the sliding pivotal connection between the base plate and the front pivot link;

DETAILED DESCRIPTION

Figure 2:
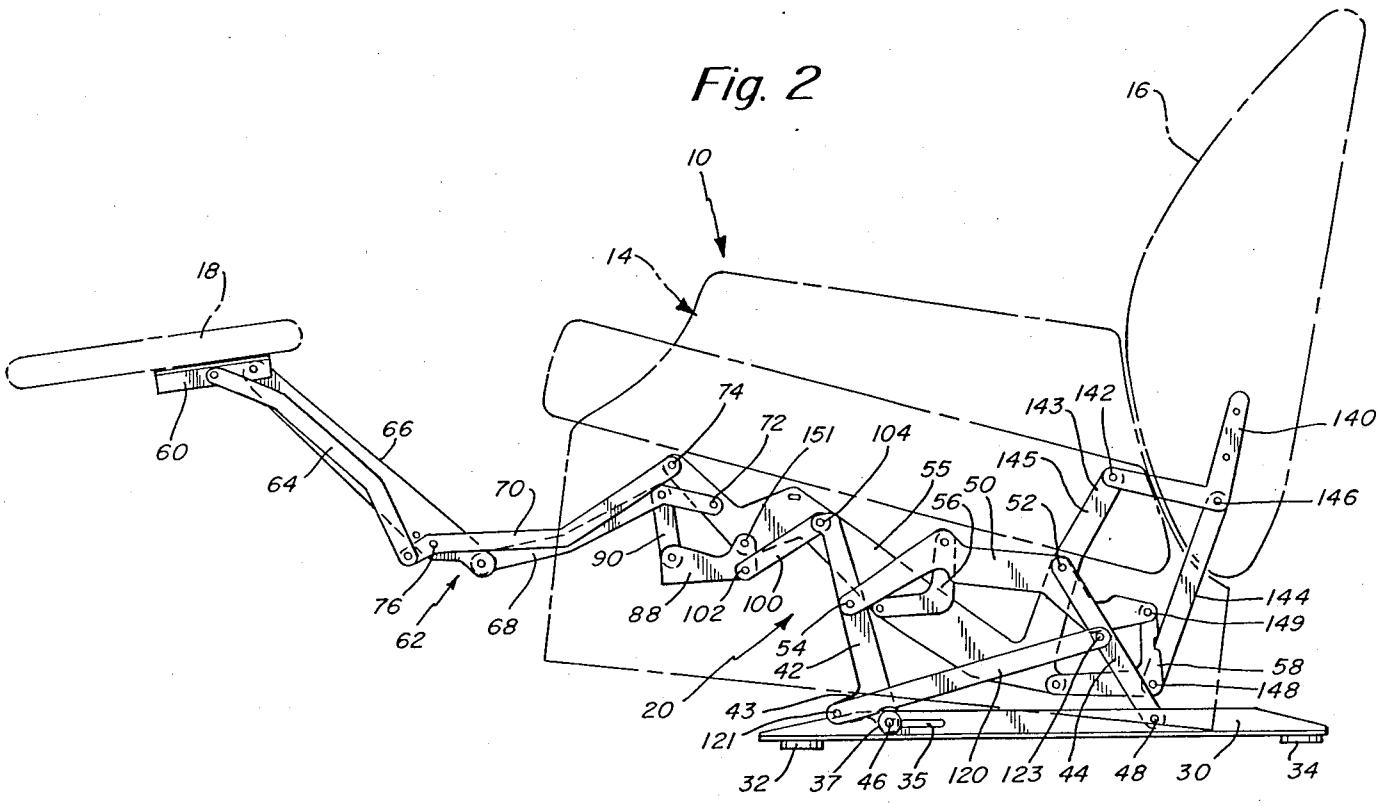
FIG. 2 is a side elevation view similar to FIG. 1 but showing the reclining chair with its mechanism in the intermediate or TV position.

The present invention is shown embodied in a reclining chair 10 having a base 12, a seat and arm panel assembly 14, a backrest 16 and a footrest 18. The seat and arm panel assembly 14, backrest 16 and footrest 18 are mounted on the base 12 and secured to one another by a pair of linkage mechanisms 20, one on each side of the chair. The two mechanisms are mirror images of one another and only one is described below. The mechanisms 20 enable the chair to move between the upright position shown in FIG. 1, the TV position shown in FIG. 2 and the fully reclined position of FIG. 3, and this may be carried out with the backrest 16 placed just approximately four or five inches from the wall when the chair is upright.

Each linkage mechanism includes a base plate 30 forming part of base 12 and extending front to back of the base. The base plate 30 is formed of a steel angle member (see FIG. 4), and is supported on feet 32 and 34 which protect the floor.

Figure 3:
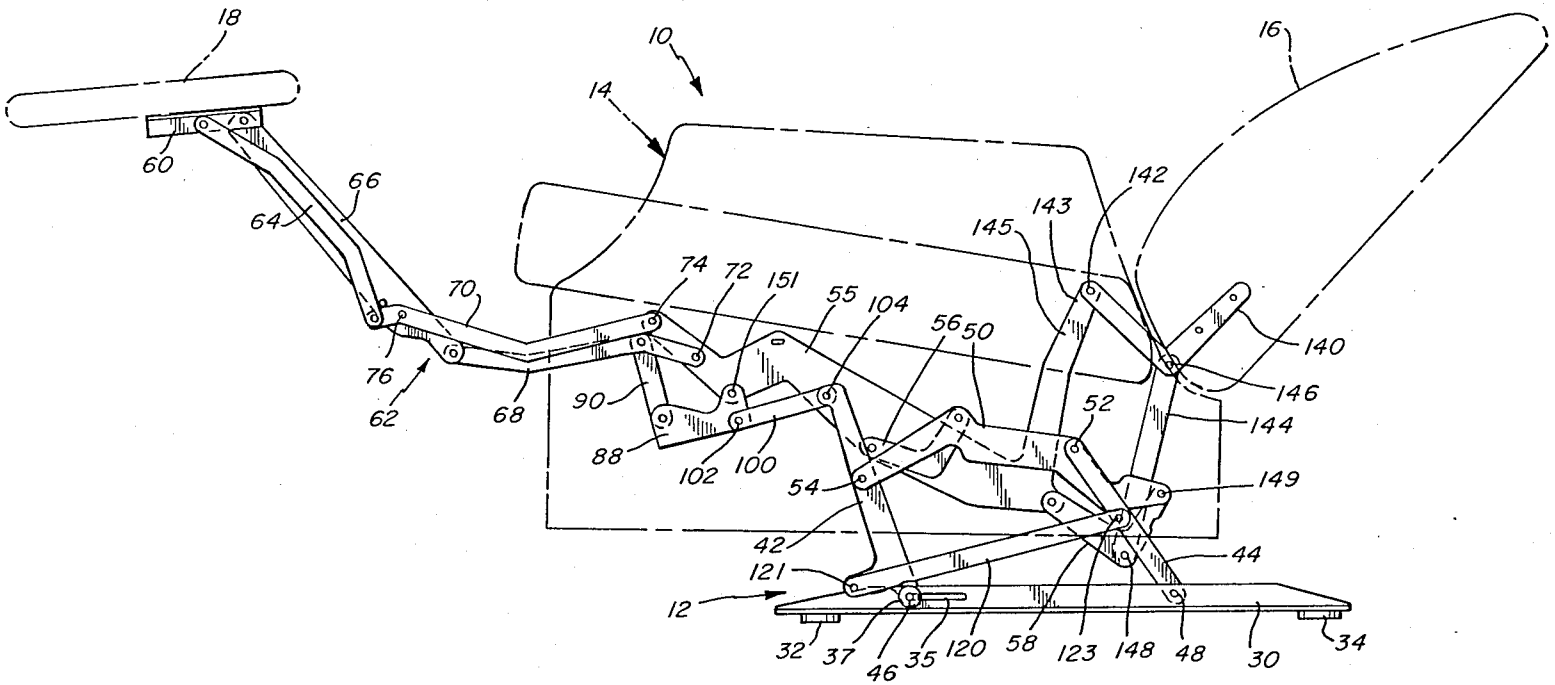
FIG. 3 is a side elevation view similar to FIGS. 1 and 2, but showing the chair in the fully reclined position.

As is clearly shown in FIGS. 1-3, base plate 30 carries front and rear pivot links 42 and 44 secured to the base plate at their lower ends by rivets 46 and 48, respectively. The front and rear pivot links 42 and 44 in turn are connected to and carry a support link 50. The upper end of rear pivot link 44 is connected to the support link by rivet 52 while the front pivot link 42 is connected to the front end of support link 50 by rivet 54 disposed intermediate the ends of the front pivot link (see FIGS. 2 and 3). In the upright position of the chair shown in FIG. 1, the front and rear pivot links 42 and 44 are inclined slightly upwardly and rearwardly from the base plate 30. The base plate 30, front and rear pivot links 42 and 44, and support link 50 together define a four-bar linkage which permits the support link 50 to move forwardly from the position of FIG. 1 to the position of FIGS. 2 and 3 when the chair is moved from upright to TV position. That action is described more fully below. It will be appreciated from an examination of FIG. 1 and the disposition of the front and rear pivot links 42 and 44 that a downwardly directed force on the support link 50 such as is generated by a person sitting in the chair tends to retain the support link in the position shown. That is, the downwardly directed force would not tend to swing the support link 50 in a forward direction with respect to the base plate 30.

While the base plate 30, front and rear pivot links 42 and 44 and support link 50 are described as a four-bar linkage, the pivotal connection between the front pivot link 42 the base plate is not fixed, but rather moves in a horizontal slot 35 in the vertical flange 36 of the angle member that defines the base plate 30. As shown in FIG. 4, rivet 46 connected to the lower end of front pivot link 42 passes through slot 35 and carries a roller 37 that rides on the horizontal flange 38 of the angle member. A washer 39 is disposed between the pivot link 42 and the vertical flange 36 to reduce friction as the roller moves on flange 38 and the rivet slides in the slot 35. Thus, the slot, rivet and roller define a track connection between the base plate 30 and front pivot link 42.

As is described more fully below, the front and rear pivot links 42 and 44 are connected by a control link 120. The connection of the control link 120 to the front pivot link 42 is by means of a rivet 121 which engages an extension 43 formed as an integral part of the front pivot link. Control link 120 is connected to rear pivot link 44 by rivet 123. The control link 120 coordinates the pivotal motion of the rear pivot link 44 with the sliding movement of the front pivot link rivet 46 in track 35.

The support link 50 carries a seat mounting link 55 on a pair of swing links 56 and 58 which are sometimes termed a seat support link and seat drive link, respectively. The seat mounting link 55 and the swing links 56 and 58 along with the support link 50 also define a four-bar linkage which enables the seat mounting link to move in a swinging motion fore and aft with respect to the support link as is more specifically described below.

The seat mounting link 55 is secured directly to the seat and arm panel assembly 14 and carries that assembly with it as the seat mounting link moves from one to another of the three positions to which it moves as the mechanism is operated.

Footrest 18 is best shown in FIGS. 2 and 3 to be mounted on a footrest bracket 60 that in turn is carried by a lazy tong linkage 62 mounted on the forward end of the seat mounting link 55. The lazy tong linkage includes a pair of links 64 and 66 each connected at one end to footrest bracket 60 and at their other ends to the links 68 and 70, respectively. Rivets 72 and 74 pivotally connect the links 68 and 70 to the seat mounting link 55. Link 70 is also pivotally connected to the link 66 by rivet 76, which causes the lazy tong linkage to act in the conventional manner so as to extend the footrest 18 to the position of FIGS. 2 and 3 when the linkage is opened and to retract the footrest 18 to the position of FIG. 1 when the lazy tong linkage is closed.

Figure 5:
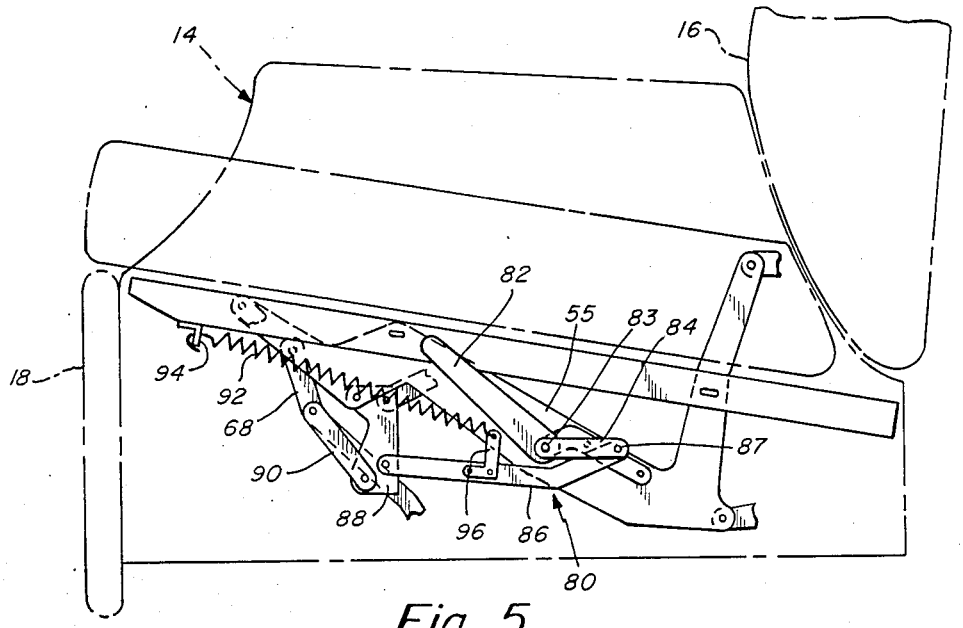
FIG. 5 is a fragmentary side view of the chair in the upright position and showing the handle actuating subassembly connected to the linkage mechanism.
Figure 6:
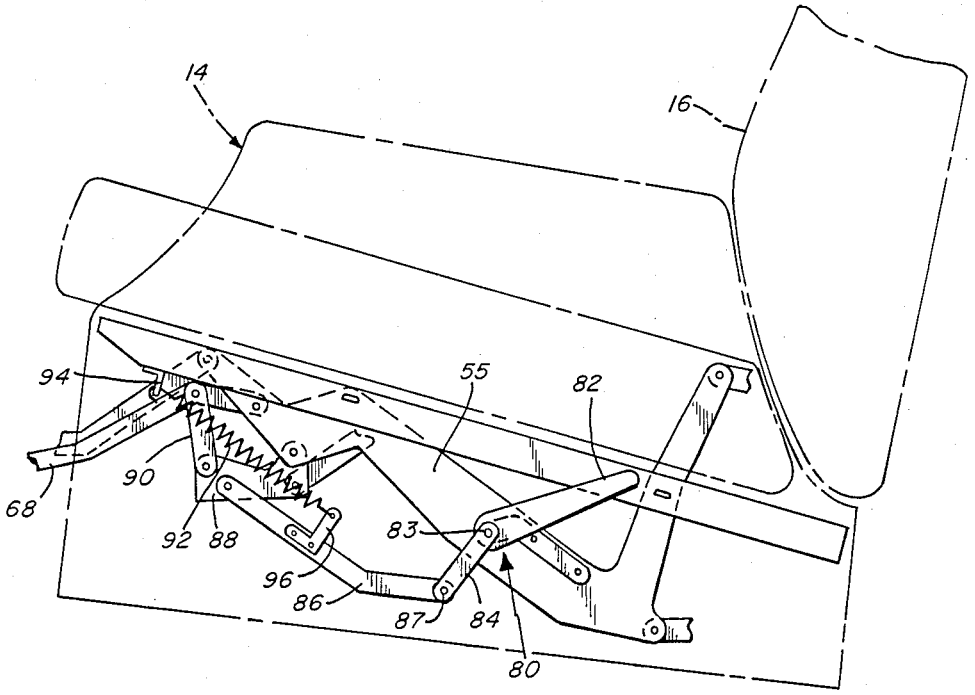
FIG. 6 is fragmentary side view similar to FIG. 5 but showing the handle actuating subassembly and mechanism in the TV position.

The lazy tong linkage is actuated by a handle assembly 80 shown in FIGS. 5 and 6. The handle assembly 80 includes a handle 82 pivotally mounted on the seat mounting link 55 by pivot pin 83. The handle 82 is keyed to and pivots a first actuating link 84 which in turn is connected to a second actuating link 86 by pin 87. The second actuating link 86 is connected at its forward end to a drive transfer link 88. The drive transfer link 88 in turn is connected by a sequencing link 90 to the lazy tong link 68.

When the second actuating link 86 moves to the left from the position in FIG. 5 to that of FIG. 6, it pivots the drive transfer link 88 in a clockwise direction which in turn elevates the sequencing link 90 so as to cause the lazy tong linkage to open and elevate footrest 18 (see also FIGS. 2 and 3). This action is assisted by a coil spring 92 extending under tension between an eye 94 on the side panel assembly 14 and a bracket 96 fixed to the second actuating link 86. Spring 92 urges the actuating link 86 to the left, and this in turn causes the action of the drive transfer link 88 and sequencing link 90 described above. As a result, very little force need be applied to handle 82. When the handle pivots clockwise as viewed in FIG. 5 and causes the pin 87 to pass over the axis of spring 92, the spring 92 will immediately take over and provide the force required to elevate the footrest.

A footrest drive link 100 is also pivoted at one end to the drive transfer link 88 by rivet 102 (see FIGS. 1 and 3), and its other end is pivoted by means of rivet 104 to the upper end of front pivot link 42. The manner in which the footrest drive link cooperates with the drive transfer link in the movement of the chair between its various positions is described more fully below.

The chair mechanism is completed by a backrest bracket 140 pivoted by rivet 142 to the upper end 143 of arm 145 which is integral with and part of the seat mounting link 55. The bracket 140 as is evident in the drawings, supports backrest 16 for pivotal motion with respect to the seat and arm panel assembly 14. The bracket 140 is supported by a back support link 144 connected to it by rivet 146. Link 144 is also connected by rivet 148 to the rear swing link or seat drive link 58. When the backrest is pivoted rearwardly about rivet 142 with respect to the seat and arm panel assembly 14, the back support link 144 pushes the lower portion of the seat drive link 58 in a forward direction causing that link to pivot clockwise about rivet 149, which in turn causes the seat mounting link 55 to swing in a forward direction with respect to the support link.

The chair operates as follows:

An occupant of the chair sitting upright with the chair in the position of FIG. 1 and wishing to recline the chair to the TV position of FIG. 2 or the fully reclined position of FIG. 3 merely pulls the top of handle 82 rearwardly from the position of FIG. 5 to the position of FIG. 6. This action causes the first and second actuator links 84 and 86 to move toward the front of the chair so as to pivot the drive transfer link 88 from the position of FIGS. 1 and 5 to the position of FIGS. 2 and 6. As the pin 87 passes across the axis of the spring 92, this actuation is assisted by the spring, which serves to draw the second actuator link 86 in a forward direction.

Rotation of the drive transfer link about its pivotal mounting 151 on the seat link does two things. First, it draws the footrest drive link 100 downwardly and to the left from the position of FIG. 1 to the position of FIG. 2, which in turn causes the front pivot link 42 and rear pivot link 44 to move over center (across the vertical position). As a result, the downwardly directed force applied by the weight of the occupant causes the support link 50 to move forwardly and downwardly with respect to the base plate 30 which supports it. It also causes the weight of the occupant to push the footrest drive link 100 further downwardly and assist in rotating the transfer link 88 about its pivotal support 151. Second, the pivotal shifting of the drive transfer plate 88 acts upon the sequence link 90 to pivot the lazy tong link 68 about is pivotal support 72 on the seat mounting link and thereby extend the lazy tong linkage and footrest to the elevated position of FIG. 2.

The pivotal movement of the rear pivot link 44 to the left as viewed in FIG. 1 under the weight of the occupant also moves the control link 120 generally to the left, which pushes the sliding pivot rivet 46 forwardly in the slot 35 to the forward end thereof. That action reduces the arc through which the front pivot link 42 must move to achieve the forward motion of the seat and back assembly 14 on the base plate 30. Consequently, the front edge of the seat does not tip downwardly, and a very comfortable seat angle is achieved. During this sequence, the seat mounting link 55 remains essentially fixed with respect to the support link 50. That is, the two move forward together as the support link 50 swings in a forward direction as the front and rear pivot links 42 and 44 pivot counterclockwise as viewed in FIGS. 1 and 2. As a result, the seat assembly 14, comprising the seat and arm panels along with the backrest 16 which are all carried either directly or indirectly by the seat mounting link advance from the upright position shown in FIG. 1 to the TV position of FIG. 2 without a change in their positions relative to one another. The top of backrest 16 pivots slightly rearwardly in a clockwise direction toward the wall behind the chair. The forward movement of the seat and arm panel assembly 14 and the backrest 16 by the action of the front and rear pivot links 42 and 44 and the forward movement of the front pivot link 42 in slot 35 more than compensates for the change in angle of the back from upright to TV position so as to prevent the backrest from engaging the wall.

If the occupant in the TV position wants to place the chair in the fully reclined position of FIG. 3, he or she need only push against the arms 15 and backrest 16. This action causes the backrest bracket 140 to pivot on its support 142 in a clockwise direction from the position of FIG. 2 to the position of FIG. 3, and the backrest support link 144 as a result rotates the seat drive link 58 about its pivotal connection 149 on the support link 50, which advances the seat mounting link 55 with respect to the support link 50. The advancing motion of the seat mounting link 55 causes the seat and arm panel assembly 14 as well as the backrest 16 to move further forward on the base plate 30 to the position shown in FIG. 3. During this action, the footrest 18 remains essentially fixed with respect to the seat. The additional motion of the entire assembly away from the wall provides more than enough room for the backrest 16 to pivot rearwardly with respect to the seat without interference from the wall adjacent which the chair is placed.

To return the fully reclined chair to the TV or upright positions of FIGS. 2 and 1, respectively the occupant need only relieve the pressure against the backrest 16. This will cause the seat mounting link 55 to swing rearwardly on the seat support link 56 and seat drive link 58 suspended on support link 50, and the assembly will return to the position of FIG. 2. Pivot rivet 46 will remain, however, at the front end of slot 35. It should be appreciated that by applying the appropriate pressure against the backrest 16, the occupant may maintain the chair in any intermediate position between those shown in FIGS. 2 and 3. To proceed to the fully upright position, the occupant need only apply a downward pressure on the footrest 18, which will close the lazy tong linkage 62 and pivot the drive transfer link 88 in a counterclockwise direction about its mounting 151 on the seat mounting link, which in turn will cause the front pivot link 42 to pivot clockwise and impart the same action to the rear mounting link 44. This in turn causes the control link 120 to drag the sliding rivet pivot 46 in a rearwardly direction supported by the roller on the horizontal flange of the base plate. In this fashion, the chair moves to the fully upright position of FIG. 1.

From the foregoing, it will be appreciated that a chair constructed in accordance with the present invention having a normal height of approximately 36 inches may be placed within four or five inches of the wall and will be able to move to the fully reclined position without interference. The combination of the linkage and slide track provides sufficient forward travel of the seat and backrest assembly 14 on the base plate so as to compensate for the angle change of the backrest as it moves from the upright to the TV position and on to the fully reclined position if the chair is initially placed away from the wall the short distance indicated.

Most importantly, the mechanism of the present invention while substantially less expensive than the mechanisms of the prior art having full roller links supported on tracks on the base plate and which carry the front and rear pivot links, nevertheless, enables a chair to be placed in close proximity to a wall or other furniture without any interference with its reclining action. This saving in achieved by the elimination of the separate channels which serve as the tracks, one of the two rollers on each mechanism, and the roller link itself. Those changes result in a reduction of approximately 10% in the manufacturing costs of the mechanisms and is reflected in the selling price of the chairs.

The short travel of the bottom of the front pivot link provides a more stable platform for the chair with the resulting increased comfort for the occupant. The longer travel of roller links in tracks present in some of the prior art chairs creates a sense of instability, which is unsettling to some users.

Having described this invention in detail, those skilled in the art will appreciate that numerous modifications may be made of the invention without departing from its spirit. Therefore, it is not intended that the scope of this invention be limited to the single embodiment illustrated and described. Rather, the scope of this invention is to be determined by the appended claims and their equivalents.

I claim:

1. A three-position reclining chair having a base, a pair of side panels, a seat and backrest mounted between the side panels and wherein the seat and backrest are movable relative to each other, and a linkage mechanism for supporting the seat and backrest, said mechanism comprising a base plate, a back pivot link pivotally mounted on the base plate, a track on the forward portion of base plate, a front pivot link pivotally mounted on the base plate, the pivotal connection between the front pivot link and base plate being slidable fore and aft in the track, a support link pivotally connected to and carried by the front and back pivot links, a seat drive link and a seat support link pivotally connected to the support link and in turn carrying a seat mounting link, said seat mounting link carrying the seat, a control link connected to the front and back pivot links for controlling the position of the pivotal connection in the track, a footrest and a lazy tong linkage carrying the footrest and secured to the seat mounting link, a handle actuating mechanism including a handle pivotally mounted on the seat mounting link and connected to the lazy tong linkage for causing the lazy tong linkage to extend the footrest and the front and back pivot links to pivot with the support link in a forward direction and the pivotal connection to move forwardly in the track, said front and back pivot links passing from a rearwardly inclined to a forwardly inclined position, whereby the weight of the occupant causes the seat and seat mounting link to move from an upright position to an intermediate position, and a backrest linkage carrying the backrest and pivotally connecting it to the seat mounting link causing backward pressure against the backrest by the seat occupant with the chair in the intermediate position to pivot the backrest rearwardly with respect to the seat and move the seat upwardly and forwardly with respect to the base plate so as to move the chair to a fully reclined position.

2. A chair as described in claim 1 wherein the pivotal connection between the front pivot link and base plate comprises a vertical plate and horizontal base rail forming part of the base plate, a slot comprising the track extending fore and aft in the vertical plate, a roller on the base rail and having a rivet shaft which extends through the slot and is pivotally connected to the front pivot link.

3. A reclining chair as described in claim 1 wherein the seat and side panels are rigidly connected with one another and move together with the seat mounting link.

4. A three-position reclining chair comprising a base plate, a rear pivot link pivotally connected at a fixed point to the base plate, a track in the forward portion of the base plate, a front pivot link pivotally connected to the base plate in the track so that the pivotal connection slides fore and aft on the base plate, a support link carried by the pivot links, a pair of swing links connected to the support link and carrying a seat mounting link, a seat and arm assembly fixed to and movable with the seat mounting link, a control link connected to the front and rear pivot links for controlling the position of the pivotal connection of the front mounting link in the track, a handle actuating mechanism connected to the front pivot link for pivoting the front pivot link in a forward direction to in turn move the support link in a forward direction along with the rear pivot link and to cause the pivotal connection of the front pivot link to move forwardly in the track, a backrest pivotally mounted on the seat mounting link, and a linkage connecting the backrest to one of the swing links causing pressure exerted against the backrest of the chair to pivot the backrest by the occupant of the chair to pivot the backrest rearwardly with respect to the seat and arm assembly and to move the seat and arm assembly forwardly with respect to the base plate.

5. A three-position reclining chair having a base, a pair of side panels, a seat and backrest mounted between the side panels and wherein the seat and backrest are movable relative to each other, and a linkage mechanism for supporting the seat and backrest, said mechanism comprising a base plate, a back pivot link pivotally mounted on the base plate, a track on the forward portion of base plate, a front pivot link pivotally mounted on the base plate, the pivotal connection between the front pivot link and base plate being slidable fore and aft in the track, a support link pivotally connected to and carried by the front and back pivot links, a pair of swing links pivotally connected to the support link and in turn carrying a seat mounting link, said seat mounting link carrying the seat, a control link connected to the front and back pivot links for controlling the position of the pivotal connection in the track, a footrest and a lazy tong linkage carrying the footrest and secured to the seat mounting link, a handle actuating mechanism including a handle connected to the lazy tong linkage for causing the lazy tong linkage to extend the footrest and the front and back pivot links to pivot with the support link in a forward direction and the pivotal connection to move forwardly in the track, said front and back pivot links passing from a rearwardly inclined to a forwardly inclined position, whereby the weight of the occupant causes the seat and seat mounting link to move from an upright position to an intermediate position, and a backrest linkage carrying the backrest and pivotally connecting it to the seat mounting link causing backward pressure against the backrest by the seat occupant with the chair in the intermediate position to pivot the backrest rearwardly with respect to the seat and move the seat upwardly and forwardly with respect to the base plate so as to move the chair to a fully reclined position.

6. A chair as described in claim 5 wherein the pivotal connection between the front pivot link and base plate comprises a vertical plate and horizontal base rail forming part of the base plate, a slot comprising the track extending fore and aft in the vertical plate, and a roller on the base rail and having a rivet shaft which extends through the slot and is pivotally connected to the front pivot link.

7. A reclining chair as described in claim 5 wherein the handle is pivotally mounted on the seat mounting link.

8. A three-position reclining chair having a base, a pair of side panels, a seat and backrest mounted between the side panels and a linkage mechanism for supporting the seat and backrest, said mechanism comprising a base plate, a back pivot link pivotally mounted on the base plate, a track on the forward portion of base plate, a front pivot link pivotally mounted on the base plate, the pivotal connection between the front pivot link and base plate being slidable fore and aft in the track, a support link pivotally connected to and carried by the front and back pivot links, a pair of swing links pivotally connected to the support link and in turn carrying a seat mounting link, said seat mounting link carrying the seat, a control link connected to the front and back pivot links for controlling the position of the pivotal connection in the track, a footrest and a lazy tong linkage carrying the footrest and secured to the seat mounting link, a handle actuating mechanism including a handle connected to the lazy tong linkage for causing the lazy tong linkage to extend the footrest and the front and back pivot links to pivot with the support link in a forward direction and the pivotal connection to move forwardly in the track, whereby the seat and seat mounting link move from an upright position to an intermediate position, and a backrest linkage carrying the backrest and pivotally connecting it to the seat mounting link causing backward pressure against the backrest by the seat occupant with the chair in the intermediate position to pivot the backrest rearwardly with respect to the seat and move the seat upwardly and forwardly with respect to the base plate so as to move the chair to a fully reclined position.

9. A chair as described in claim 8 wherein the pivotal connection between the front pivot link and base plate comprises a vertical plate and horizontal base rail forming part of the base plate, a slot comprising the track extending fore and aft in the vertical plate, a roller on the base rail and having a rivet shaft which extends through the slot and is pivotally connected to the front pivot link.

10. A reclining chair as described in claim 9 wherein the handle is pivotally mounted on the seat mounting link.

11. A mechanism for a three-position reclining chair comprising a base plate, a back pivot link pivotally mounted on the base plate, a track on the forward portion of base plate, a front pivot link pivotally mounted on the base plate, the pivotal connection between the front pivot link and base plate being slidable fore and aft in the track, a support link pivotally connected to and carried by the front and back pivot links, a pair of swing links pivotally connected to the support link and in turn carrying a seat mounting link, a control link connected to the front and back pivot links for controlling the position of the pivotal connection in the track, a lazy tong linkage for carrying a footrest and secured to the seat mounting link, a handle actuating mechanism including a handle connected to the lazy tong linkage for causing the lazy tong linkage to extend and the front and back pivot links to pivot with the support link in a forward direction and the pivotal connection to move forwardly in the track, said front and back pivot links passing from a rearwardly inclined to a forwardly inclined position, and a backrest linkage for carrying a backrest and pivotally connecting it to the seat mounting link, said backrest linkage also being connected to one of the swing links causing backward pressure against the backrest linkage to pivot the backrest linkage rearwardly with respect to the seat mounting link and move the seat mounting link upwardly and forwardly with respect to the base plate.

12. A mechanism as described in claim 11 wherein the pivotal connection between the front pivot link and base plate comprises a vertical plate and horizontal base rail forming part of the base plate, a slot comprising the track extending fore and aft in the vertical plate, and a roller on the base rail and having a rivet shaft which extends through the slot and is pivotally connected to the front pivot link.

* * * * *